US005216863A

United States Patent [19]

Nessa et al.

[11] Patent Number: 5,216,863

[45] Date of Patent: Jun. 8, 1993

[54] FORMWORK COMPRISING A PLURALITY OF INTERCONNECTABLE FORMWORK ELEMENTS

[76] Inventors: Nils Nessa, Vemorkveien 6, N-4300 Sandnes; Dag Pettersen, Hemmestveittunet 14, N-4021 Hafresfjord, both of Norway

[21] Appl. No.: 655,403

[22] PCT Filed: Jul. 19, 1989

[86] PCT No.: PCT/NO89/00074

§ 371 Date: Apr. 12, 1991

§ 102(e) Date: Apr. 12, 1991

[87] PCT Pub. No.: WO90/01595

PCT Pub. Date: Feb. 22, 1990

[30] Foreign Application Priority Data

Aug. 15, 1988 [NO] Norway ..... 883623
Jul. 10, 1989 [NO] Norway ..... 892844

[51] Int. Cl.[5] ..... E04B 1/16; E04B 2/00; E04C 3/30; F16B 5/07

[52] U.S. Cl. ..... 52/439; 52/309.15; 52/309.17; 52/588; 249/18; 249/173; 264/32; 264/35; 264/263; 264/269; 405/267; 428/33; 428/36.9; 428/99

[58] Field of Search ..... 52/421, 436, 437, 439, 52/309.11, 588, 309.15, 309.17; 405/267; 249/48, 18, 173; 264/31-35, 313, 263, 267, 269, 273, 274, 333, DIG. 57, DIG. 64, DIG. 44; 428/33, 99, 36.9

[56] References Cited

U.S. PATENT DOCUMENTS

| | | | |
|---|---|---|---|
| 1,244,608 | 10/1917 | Hicks | 249/48 |
| 1,715,466 | 6/1929 | Miller | 52/436 |
| 2,008,162 | 7/1935 | Waddell | 249/48 |
| 2,892,340 | 6/1959 | Fort | 52/439 |
| 3,100,677 | 8/1963 | Frank et al. | 264/313 X |
| 3,588,027 | 6/1971 | Bowden | 249/48 |
| 3,788,020 | 1/1974 | Gregori | 52/439 X |
| 4,553,875 | 11/1985 | Casey | 52/743 X |
| 4,731,971 | 3/1988 | Terkl | 52/309.12 X |
| 5,014,480 | 5/1991 | Guarriello et al. | 52/439 X |

FOREIGN PATENT DOCUMENTS

| | | | |
|---|---|---|---|
| 574720 | 4/1959 | Canada | 428/33 |
| 0025420 | 3/1981 | European Pat. Off. . | |
| 1812590 | 6/1970 | Fed. Rep. of Germany . | |
| 1684357 | 4/1971 | Fed. Rep. of Germany . | |
| 3234489 | 8/1984 | Fed. Rep. of Germany . | |
| 3003446 | 4/1987 | Fed. Rep. of Germany . | |
| 3727956 | 5/1988 | Fed. Rep. of Germany . | |
| 1603005 | 4/1971 | France . | |
| 581408 | 8/1958 | Italy | 52/439 |
| 46428 | 4/1929 | Norway . | |
| WO82/04088 | 11/1982 | PCT Int'l Appl. . | |
| 206538 | 8/1966 | Sweden . | |
| 317758 | 11/1956 | Switzerland | 249/48 |
| 2205624 | 12/1988 | United Kingdom | 428/33 |

*Primary Examiner*—Karen Aftergut

[57] ABSTRACT

A formwork includes a plurality of interconnectable disposable formwork elements for the casting of, for instance, foundations, sustaining walls, etc. in concrete and which is cheaper and wherein the formwork operation is rapidly effected, and at the same time it may be done by a person not skilled in the trade. Each formwork element (1) consists of an elongated, thin-walled, cylinder-shaped element, which is provided with coupling members on the neighbor element(s) for the interconnection of adjacent cylinder-shaped formwork elements so that, upon filling of concrete into the interconnected cylinder-shaped formwork elements, a row of fused concrete columns is formed constituting a wall on which the formwork elements may form the external surface(s) or from which the external portions of the formwork elements may be removed.

6 Claims, 5 Drawing Sheets

FORMWORK COMPRISING A PLURALITY OF INTERCONNECTABLE FORMWORK ELEMENTS

BACKGROUND OF THE INVENTION

Figure 1:
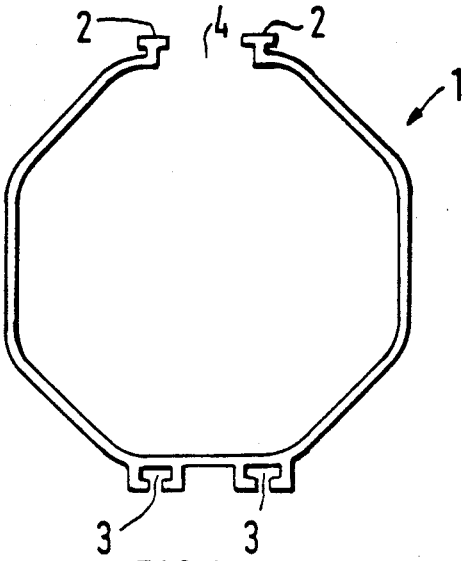

The invention relates to a formwork comprising a plurality of interconnectable formwork elements for the casting of especially walls and similar constructions, and otherwise of the kind that are substantially cylindrically-formed, thin-walled, self-supporting and preferably flexible. The invention also involves a method for the use of said formwork elements, and in particular to method for the casting of walls and similar constructions using the formwork.

Casting of e.g. foundations, sustaining walls, walls, pavement or roof in concrete or similar hardenable filling materials by means of formwork elements in the form of wooden panels is laborious and time-consuming. Such formwork panels are heavy and awkward; they have to be transported on crane vehicle and require binders, the necessary working operations comprising carrying, erecting, removal, oiling (lubrication) and storage of the panels.

Likewise, finished brick blocks and elements require much treatment in factory, costly transport, laborious erecting and comprehensive after-treatment.

The prior art comprises also Norwegian patent specification No. 46,428, DE-OS 2,213,358, DE-AS 1,684,357, U.S. Pat. No. 2,184,714, DE, C2, 3 234 489, DE, A1, 3 727 956, WO, A1, 82/04088, DE, A, 1 812 590, DE, C2, 3 003 446, SE, 206 538 as well as FR-A-1 603 005.

NO-PS 46,428 relates to a pile blanking consisting of hollow interconnectable sections. Substantially as a result of the design of the connecting means of this known pile blanking, the pile blanking will—used as a formwork—only be usable for the casting of spaced columns; on the other hand it will not enable casting of a continuous wall, or permit reinforcing using horizontal and/or diagonally extending reinforcing rods. However, between adjacent sections or elements it is from this patent specification known per se to use mutually cooperating coupling means adapted to be brought into firmly maintaining engagement with each other.

DE-OS 2,213,358 relates to a flexible, reinforced formwork cloth which is not self-supporting, but has to be used in combination with suitable walls of timber placed endwise and, thus, exhibiting substantially the same disadvantages as panel formworks.

DE-AS 1,684,357 relates also to a flexible, reinforced, not self-supporting formwork cloth divided into interconnectable sections, which can be connected mutually by means of connecting means adapted to be brought into firmly maintaining engagement with each other. This prior art formwork system does not permit casting of continuous walls and, moreover, prohibits the arrangement of crossing reinforcing rods.

U.S. Pat. No. 2,184,714 does not relate to formwork, but concerns casted pre-reinforced concrete elements. When such concrete elements or blocks are being used for building purposes, locking rods are used for keeping adjacent concrete blocks in place in the finished construction.

DE, C2, 3 234 489. This prior art structure and that of the above-mentioned Norwegian patent specification No. 46 428 resemble each other in many respects. In the embodiments shown, this construction is not suitable to be used as a formwork.

DE, A1, 3 727 956 discloses formwork elements made of light (weight) concrete and adapted to be glued together. In many respects these prior art elements, though elongated, resemble the well known concrete blocks previously discussed.

WO, A1, 82/04088 discloses methods for the building of constructions and comprises a "stay-in-place" formwork for concrete casting. The formwork elements are not self-supporting, and the erected formwork structure constitutes, in fact, a conventional thick-walled formwork requiring the use of i.e. ordinary binders.

DE, A, 1 812 590 discloses building elements; the entire formwork structure requiring elements of several different shapes. These differently shaped elements are to be kept together by tensioning means, thereby involving the use of a rather large number of loose parts.

DE, C2, 3 003 446 discloses formwork elements of the block type previously discussed and suffering from the very same drawbacks and disadvantages.

SE, 206 538 discloses hollow building or construction plates having neither mutually communicating cavities defined by adjacent plates nor protruding cooperating locking connecting means of the kind in question.

FR, A, 1 603 005 discloses a formwork having two opposing pliable walls and which may be prefabricated. The pliable walls of this prior art formwork are formed by a plurality of substantially tubular interconnectable thin-walled formwork elements exhibiting a generally C-shaped cross-sectional profile. When interconnected, a longitudinal portion of one formwork element of adjacent pairs forms a laterally extending, non-apertured, common partition wall for the pair of adjacent formwork elements. In the preferred embodiment, these prior art formwork elements are made from pliable cloth or canvas materials, leaving the elements non-self-supporting. However, in one extreme embodiment, this prior art publication suggests to make the formwork elements from flexible rolled metal plate, and in that case the formwork elements would, of course, be self-supporting. According to this French patent specification, the following methods are mentioned as being suitable for the interconnection of the tubular elements: Sewing, adhesion and welding.

The formwork elements according to FR, A, 1 603 005 lack intercommunicating apertures allowing free flow of concrete and, according to the French specification, the spaces surrounded by each one of the elements plus the partition wall of the neighbour element are to be filled successively. Before casting can take place, the interconnected elements have to be fixed or suspended between an upper and a lower fixture. This and the mentioned interconnection methods makes this prior art formwork difficult to erect, as well as the casting process being complicated. The lack of intercommunicating apertures throughout the erected formwork prohibits the use of internal, horizontally and/or diagonally extending reinforcing rods. In its self-supporting embodiment, the tubular formwork elements of rolled metal plate will be space-demanding during transport and storage.

According to the present invention one has aimed at providing a formwork system consisting of self-supporting interconnectable disposable formwork elements capable of being connected mutually in order to form especially a wall formwork, wherein the concrete or another hardenable filling material during the filling operation may flow freely between the interconnected formwork elements, so that the result becomes a continuous construction which—when the formwork is kept (not removed)—becomes coated with its material, e.g. plastic.

Likewise, one has aimed at eliminating or substantially restricting disadvantages and drawbacks in prior art formwork systems.

SUMMARY DESCRIPTION OF THE INVENTION

This object is achieved through designing the formwork elements with apertures arranged in at least two element portions mutually angularly displaced in (imaginary) planes extending laterally of the longitudinal direction of each formwork element and being positioned within areas defined by the connecting means, and the connecting means are designed for releasable engagement with each other, and being located such on the formwork elements that the latter may be placed directly resting against adjacent formwork elements or such that they engage partially into the neighbour elements, thereby in each case closing said apertures externally but connecting them internally of the side walls of the formwork elements, in order to prevent leakage but establish fluid communication between adjacent chambers defined by the interior of said formwork elements. The method for the use of said formwork elements comprises erecting a formwork for a wall or similar construction through interconnecting mainly cylinder-formed, thin-walled and preferably flexible formwork elements provided with apertures arranged in at least at two element portions mutually angularly displaced in (imaginary) planes extending laterally of the longitudinal direction of each formwork element and being restricted to the areas defined by the connecting means, the connecting means of the formwork elements being designed and located such that the formwork elements during and after said interconnection are being placed directly resting against adjacent formwork elements or such that they partially engage into the neighbour elements, thereby connecting apertures of adjacent formwork elements internally and simultaneously closing said apertures externally, and finally pouring concrete or similar hardenable material into the formwork.

In an advantageous embodiment, the conditions are arranged for accomodating cross reinforcement of the resulting casted construction.

The substantially cylinder-shaped formwork elements according to the invention are interconnected so that they form e.g. a wall formwork which upon filling of concrete permits the concrete to flow freely between the formwork cylinders, so that—upon hardening of the concrete—a number of fused concrete columns constituting the resulting wall are formed.

Using a formwork in accordance with the invention, one may use less concrete around the reinforcing rods than conventional formwork allow, because the watertight formwork cylinders protect against penetrating water, etc.

When casting a foundation, one does not have to use the so-called foundation plastic along the foundation; one also saves plastering, mudding and closing of holes after the binders.

A preferred material for the cylinder-formed formwork elements according to the invention is polyvinylchloride plastic having a high impact strength and a thickness of some 1 mm, because such a material, when the formwork is kept, will give the concrete construction an attractive surface coating, but in principle there is nothing to prevent the use of cardboard or a similar material having corresponding properties and/or wall thickness, respectively.

Because of the cylinder shape, the formwork elements become strong and particularly resistant to bending. The cross-sectional form may be circular, oval or polygonal (e.g. octagonal, 16-edged and so forth); when edged the corner edges are preferably rounded. A square cross-sectional shape is also possible.

The formwork elements according to the invention may be kept after casting or their external portions removed after use. In case the formwork is to remain after casting, an advantageous formwork material may be obtained from surface-treated plastics, the casted foundation, etc., thereby becoming maintenance-free.

The formwork elements according to the invention are of very light weight and so resilient that they possibly may be stacked one within the other, whereby the transport volume and weight are substantially reduced—up to 98%—as compared with panel formwork.

When casting a foundation, the cylinder-formed formwork elements are put together on a finished casted base, or directly onto gravel. In case the resulting construction is to be cross-reinforced, reinforcing rods—which during the erection of the formwork also may serve as bracing—are inserted vertically, horizontally and possibly diagonally, as desired. For reinforced constructions, each formwork element is provided with separate holes for accomodation of horizontally and/or diagonally extending reinforcing rods, the vertical reinforcing rods being inserted through the open upper ends of the formwork elements from above, through which the concrete is filled. Subsequent to the hardening of the concrete, the foundation is finished. An ordinary foundation for a one-family house may easily be erected in one day by one person.

Besides, formwork operations by means of the cylinder-shaped thin-walled formwork elements according to the invention require less excavation works than through the use of panel formwork.

When casting a sustaining wall, one excavates to frostproof depth, whereafter the formwork elements are placed, coupled together and reinforced. If desired, excavated mass may be filled back against the formwork elements even before the concrete is filled into the formwork. Whenever the top of the sustaining wall is to extend horizontally or arch-like, the formwork elements are cut correspondingly.

The light weight and natural elasticity of the form work elements permit easy joining of e.g. two formwork elements vertically. When such joining is to be effected, it is advantageous that every second one of the lower formwork elements extend to a higher point than the intermediate ones, in order to displace the joining locations vertically. The formwork material, e.g. PVC-plastic, may be coloured.

Disposable formwork elements in accordance with the invention are well suited for casting operations above and under water, such as in wharfs and the like. When casting under water, all reinforcement can be mounted in the formwork from the surface, so that the use of divers for this kind of work becomes superfluous.

SUMMARY DESCRIPTION OF THE DRAWINGS

Figure 2:
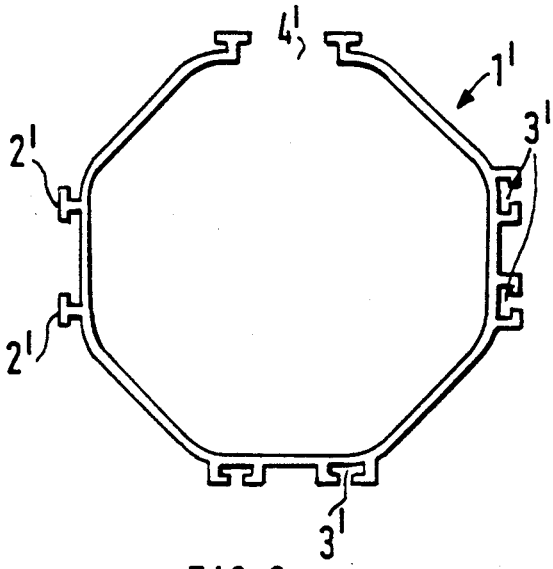
Figure 3:
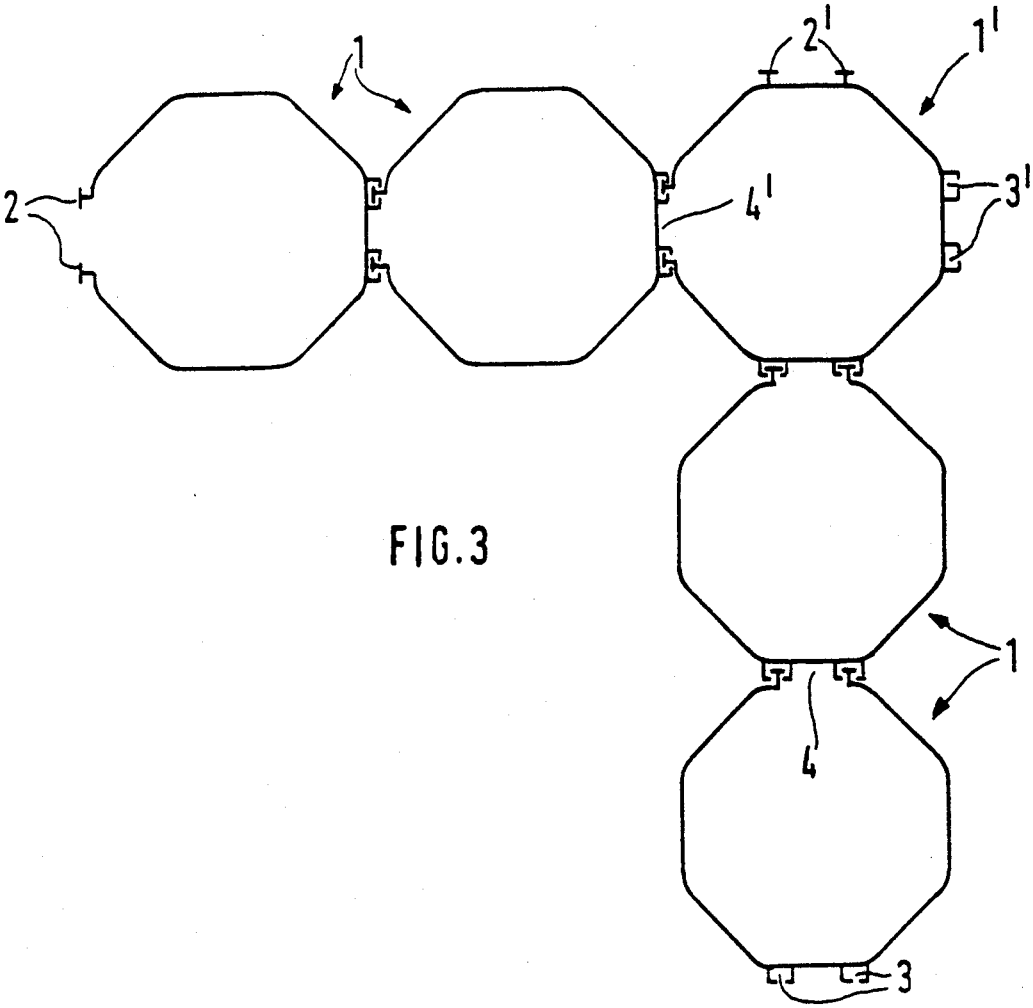
Figure 5:
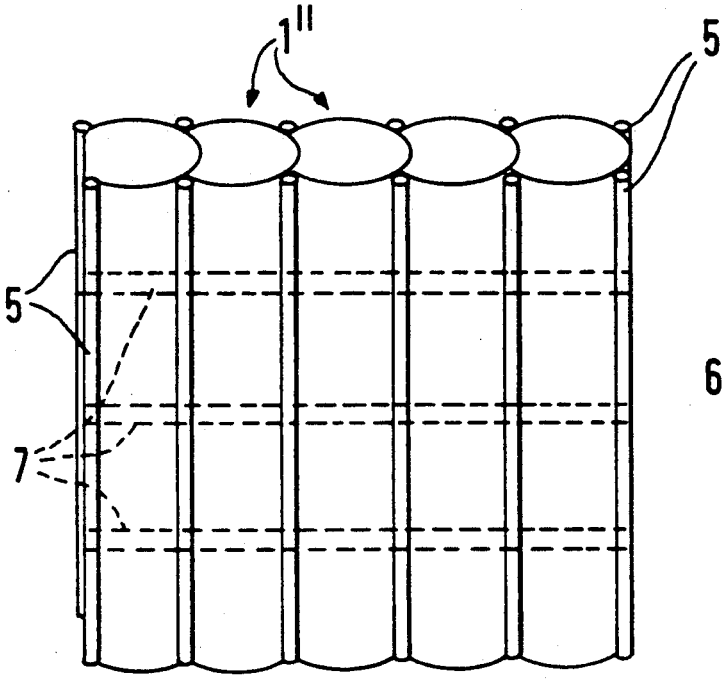
Figure 6:
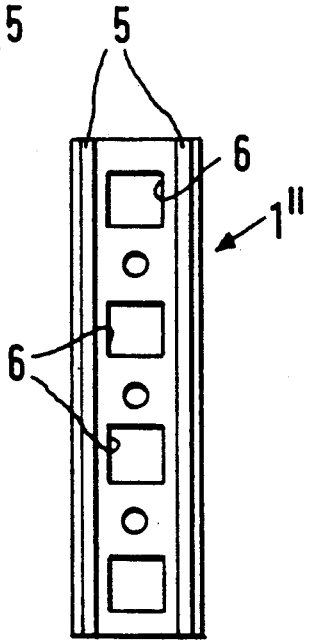
Figure 4:
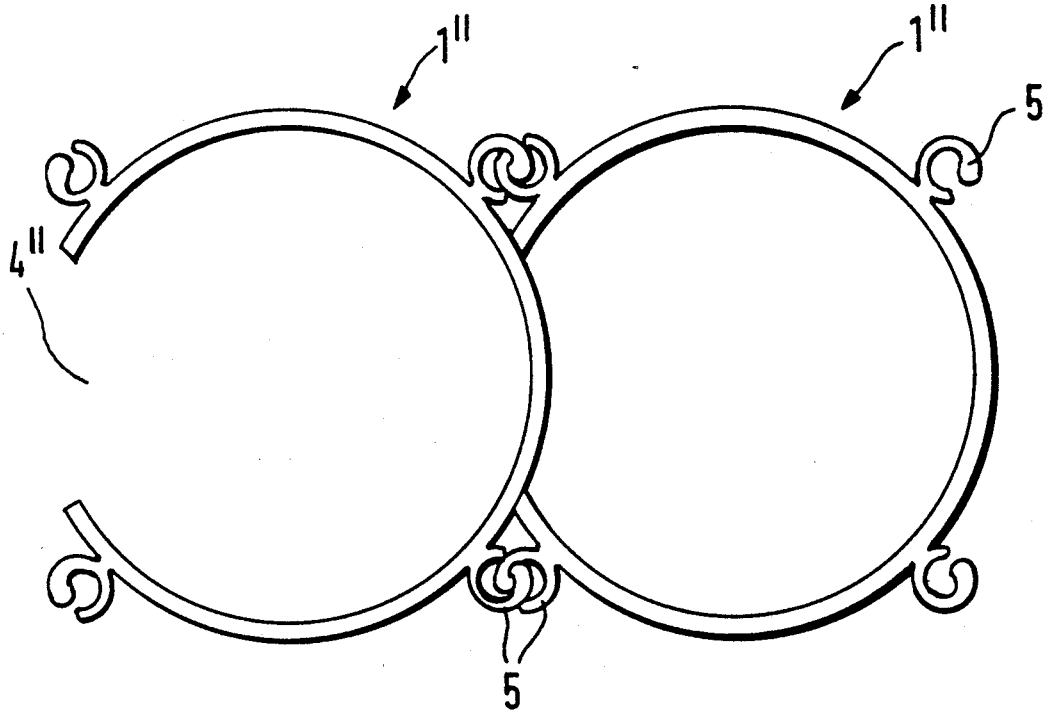
Figure 7:
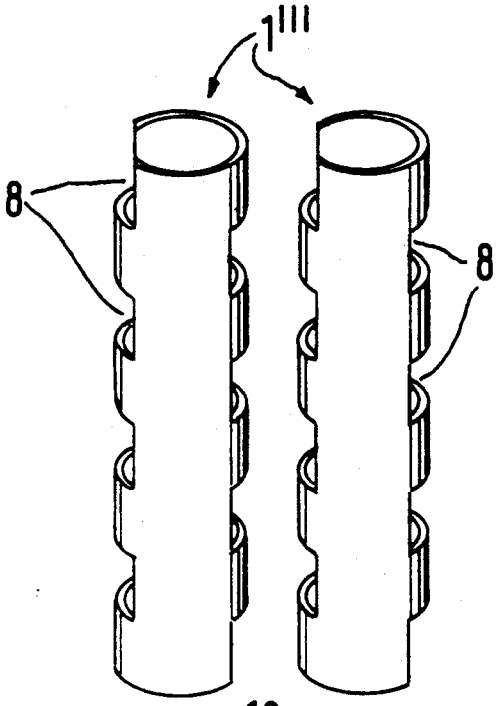
Figure 8:
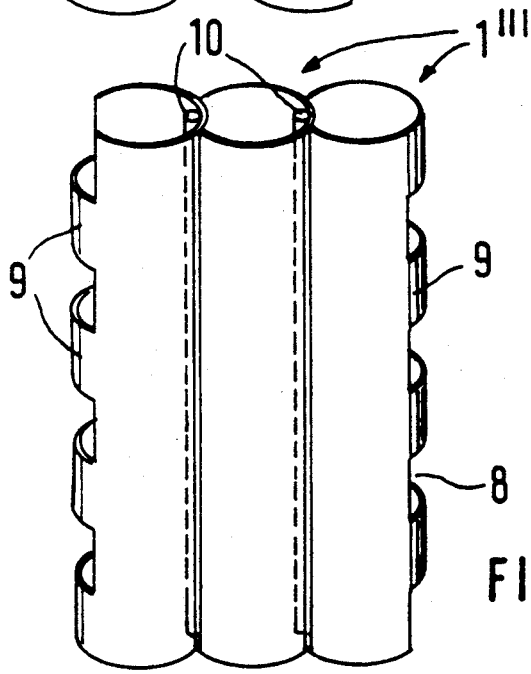
Figure 9:
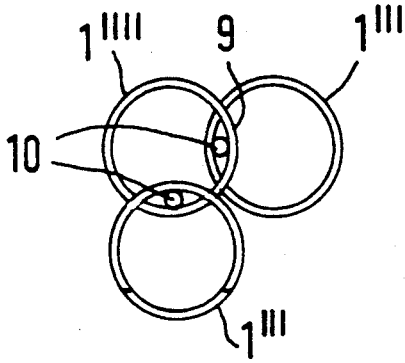
Figure 10:
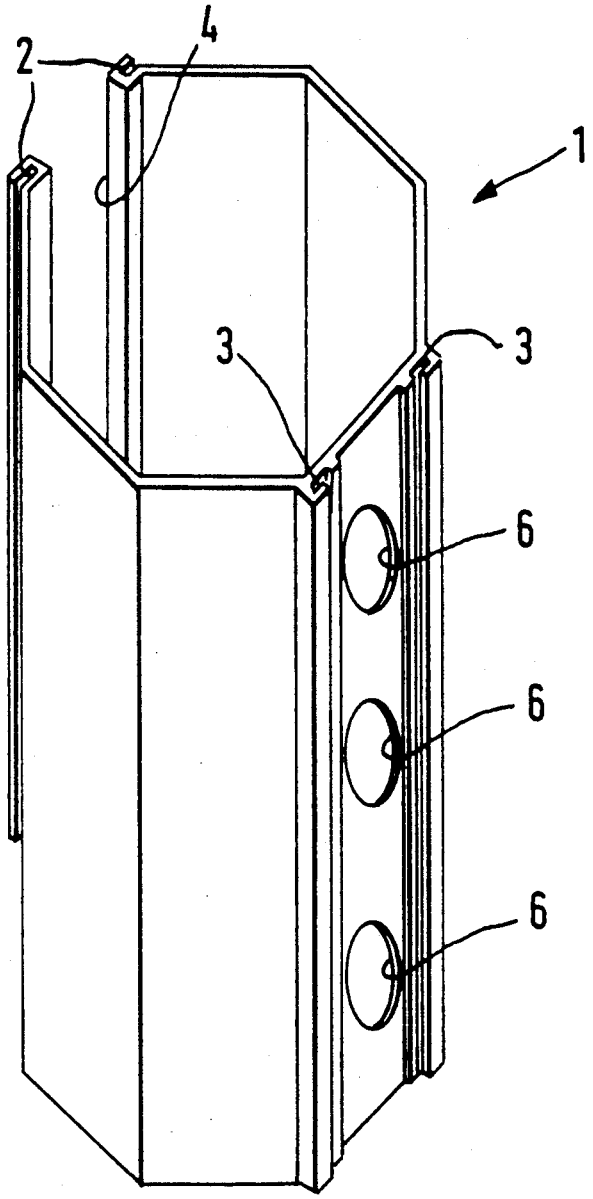
Figure 11:
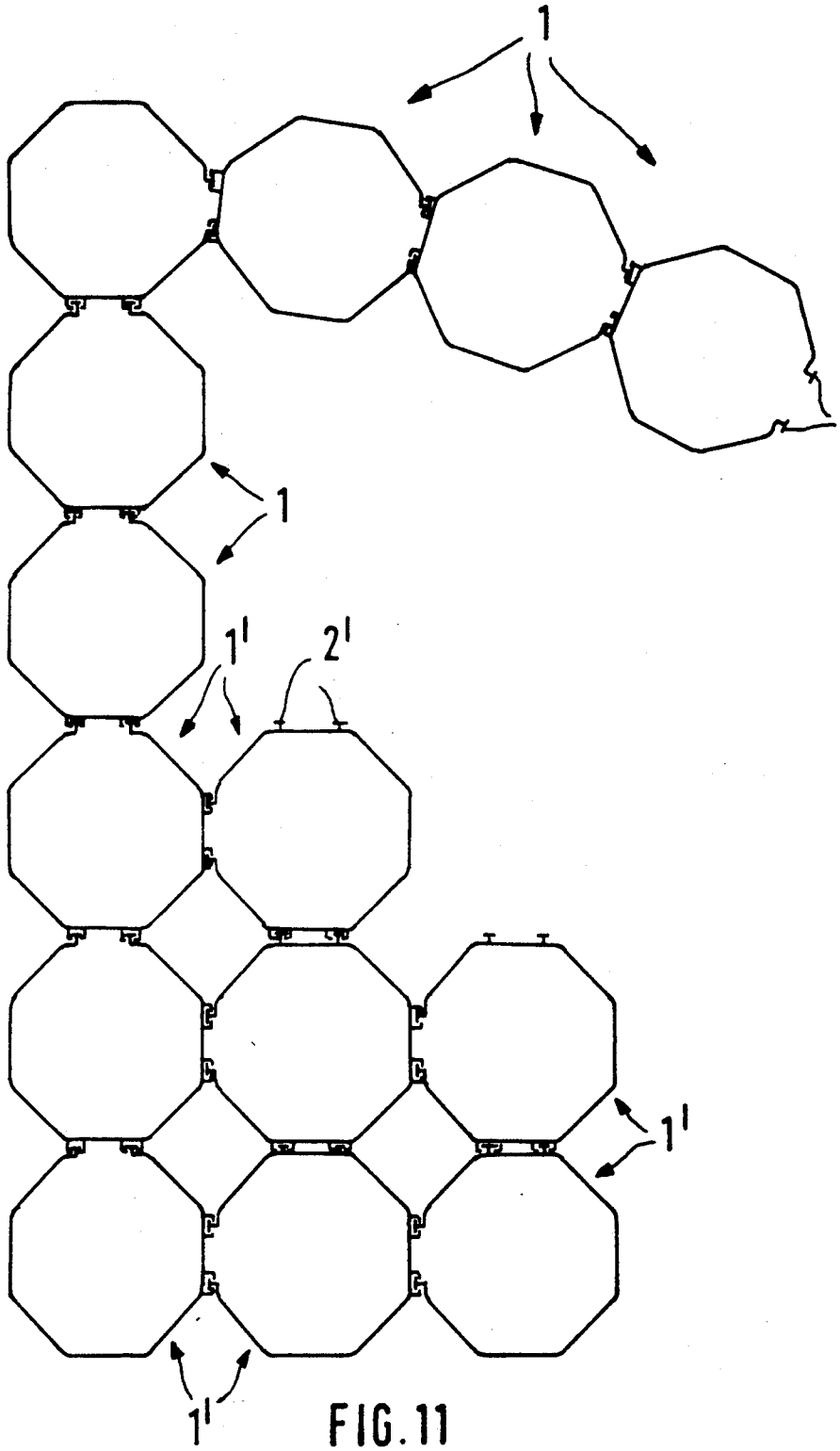

Embodiments of the invention are closer explained in the following, reference being made to the drawings, wherein:

FIGS. 1 and 2 in end view show a standard element and a corner element, respectively, in accordance with a first embodiment;

FIG. 3 in plan view shows five interconnected formwork elements—four standard elements and one corner element, of the embodiment shown in FIGS. 1 and 2;

FIG. 4 in end view shows two interconnected formwork elements according to a second embodiment;

FIG. 5 in perspective side view shows five interconnected formwork elements according to the embodiment shown in FIG. 4;

FIG. 6 shows a side wall of a formwork element (FIGS. 4 and 5) which in interconnected position engages a neighbor element;

FIG. 7 in perspective side view shows two formwork elements according to a third embodiment prior to being interconnected;

FIG. 8 in perspective side view shows three formwork elements of the embodiment shown in FIG. 7, after interconnection;

FIG. 9 in top plan view shows three interconnected formwork elements according to the third embodiment, at a formwork corner;

FIG. 10 in perspective view shows a formwork element of the embodiment shown in FIGS. 1–3; and FIG. 11 in top plan view indicates different modes of assemblage for formwork elements of the type shown in FIGS. 1–3 and 10.

FULL DESCRIPTION OF THE INVENTION

In the three embodiments according to FIGS. 1–3, 10 and 11; FIGS. 4–6 and FIGS. 7–9, respectively, the same or similar reference numerals are used for the same or corresponding parts.

In the first embodiment, FIGS. 1–3, 10 and 11, the reference numeral 1 indicates an enlongated cylindrical standard formwork element, while 1' denotes a corner element having the same general design. The elements 1, 1' have open ends.

The cylinder-shaped formwork elements 1, 1' have substantially octagonal cross-section with rounded corner edges.

At two opposite sides, the standard element 1 is provided with connecting means for interconnection with adjacent elements. The connecting means have the form of T-shaped ledges 2 and corresponding T-shaped grooves 3. The corner element, FIGS. 2 and 11, is provided with corresponding connecting means 2' and 3', respectively, on e.g. four, in pairs opposite sides. The interconnection which is ensured through the engagement of the connecting ledges 2, 2' within the grooves 3, 3', is illustrated in FIG. 3 and 11. It appears therefrom that the corner elements 1' in another embodiment may have connecting means only at two or three sides, angularly displaced 90 degrees in relation to each other.

In this embodiment, FIGS. 1–3, 10 and 11, each formwork element has at one side portion thereof an aperture 4, 4', which possibly may extend over the entire height of the formwork element, and in another side portion which (as seen in cross-section) is angularly displaced (in standard elements 180 degrees, in corner elements e.g. 90 degrees) in relation to the former side portion as well as the aperture 4, 4', equidistantly spaced apertures 6 are provided, FIG. 10, for the flowing-through of concrete between interconnected formwork elements 1, 1'.

The formwork elements 1, 1' are made of PVC-plastic, cardboard or similar material having corresponding properties. The wall thickness may be of the order 1 mm. The cylindrical shape gives the formwork elements a high strength, especially to bending, at the same time as they are resilient.

The preferably through-going apertures 4, 4' contribute strongly to this resilience and permit i.e. stacking of two or more formwork elements, one within the other, during transport.

FIG. 11 indicates some modes of assemblage for formwork elements 1, 1' according to the embodiment shown in FIGS. 1–3 and 10. Uppermost in this figure, three interconnected standard elements 1 are shown. Because of their elasticity, they have been capable of being placed along an arch-shaped or angular path. The lower portion of FIG. 11 shows the interconnection of "corner elements", both in the longitudinal and lateral direction, for the establishment of a broader formwork, without having to increase the cross-sectional dimensions of the individual formwork elements.

In the embodiment shown in FIG. 4–6, the formwork elements 1'' are circular-cylindrical and being at one side thereof provided with a through-going aperture 4'' corresponding to the apertures 4, 4', so that each separate formwork element 1'' attains an approximately C-shaped cross-section.

The formwork elements 1'' are externally provided with connecting means in the form of ledges 5 having claw-shaped cross-sectional form. The claw-shaped connecting ledges 5 are located and designed such that adjacent ledges of neighbour elements 1'' may be brought into engagement when one element 1'' is partially inserted into the longitudinal aperture 4'' of the adjacent element 1'', so that an unshakable wall formwork is achieved.

The wall portion of each formwork element 1'' located opposite the aperture 4'' is provided with equidistantly spaced apertures 6, FIG. 6, and therebetween placed holes for horizontal (and/or diagonal) reinforcing rods 7, FIG. 5. The apertures 4'', 6 permit free flow of concrete between the elements 1''.

In the embodiment according to FIGS. 7–9, the formwork elements 1''' have varying cross-sectional form over the length thereof; this being due to the design of the connecting means.

In FIG. 7, two formwork elements 1'' $\propto$ are shown prior to being interconnected. Each of these formwork elements 1''' is at two opposite sides thereof formed with spaced apertures 8, which for each element 1''' are axially displaced in relation to the apertures 8 at the opposite side, so that portions 9 between the apertures 8 of one element may be brought into engagement with the apertures 8 of a neighbour element. The interconnection is secured by means of vertical locking rods 10.

In FIG. 9 a formwork corner is shown, wherein the corner element 1'''' is somewhat differently designed than the standard elements 1'''; i.e. the corner element 1'''' having interconnecting portions 8, 9 at two sides angularly displaced 90 degrees in relation to each other.

Through designing the connecting means e.g. as shown in FIG. 4 and 5, the mutual engagement between the connecting means 5 is strengthened whenever the formwork elements are loaded from the concrete.

Practical experiments with disposable formwork elements according to the invention have shown that they in spite of minor wall thickness and low weight are capable of accomodating the forces present during casting. Formwork elements in accordance with the invention may substitute the common panel formwork in the great majority of applications of use. Thus, foundations and sustaining walls are only to be considered as examples of the invention's applicability in practice, the formwork elements also being usable for e.g. the casting of pavement and roof. When casting a pavement and a roof, the upper wall portion of the formwork elements must be provided with cavities for the filling of concrete.

One has also conceived the use of pre-connected sets of formwork elements, wherein several sets form a formwork when interconnected.

As previously mentioned, the present invention also provides a method for the casting of walls and other constructions through the use of formwork using formwork elements of the kind described in the foregoing specification.

Although other modifications and changes may be suggested by those skilled in the art, it is the intention of the inventors to embody within the patent warranted hereon all changes and modifications as reasonably and properly come within the scope of their contribution to the art.

We claim:

1. Formwork, comprising:

a plurality of interconnectable lightweight formwork elements, each of said formwork elements being an elongated, substantially cylinder-shaped member having an interior, each of said formwork elements having thin side walls which are resilient so as to enable stacking of one element within another element for transport and being sufficiently strong to be self-supporting when each formwork element is positioned with a longitudinal extent thereof in a vertical direction, said interior of each formwork element defining a longitudinal chamber, each formwork element including means along said longitudinal extent for interconnection of said formwork elements, said means for interconnection extending along longitudinal edges of said side walls of said formwork elements, each of said formwork elements having means for defining at least one aperture in an element portion mutually displaced from a longitudinally throughgoing aperture defined by said means for interconnection extending along said longitudinal edges, so that each of said formwork elements is of a substantially C-shaped cross-sectional form, and said means for interconnection on each formwork element being releasably engageable with the means for interconnection on each other formwork element, and being located on said formwork element such that when said means for interconnection are interconnected said formwork elements are located so as to close said apertures externally of said side walls of said formwork elements while also connecting said apertures internally of said side walls of said formwork elements in order to prevent leakage out of the interconnected formwork elements while establishing fluid communication between adjacent chambers defined by said interiors of said interconnected formwork elements.

2. Formwork as defined in claim 1, wherein each of said formwork elements has means for defining separate holes for accommodating reinforcing rods.

3. Formwork as defined in claim 1, wherein each of said substantially C-shaped formwork elements is a regular polygon.

4. Formwork as defined in claim 1, wherein each of said substantially C-shaped formwork elements is substantially circular.

5. Formwork as defined in claim 1, further comprising a corner formwork element having apertures, said apertures of said corner formwork element being angularly displaced from each other.

6. Formwork as defined in claim 1, wherein said at least one aperture defined in said element portion of each of said formwork elements only extends over a fraction of said longitudinal extent of each of said formwork elements, and said element portion of each of said formwork elements includes several of said apertures being defined along said longitudinal extent of each of said formwork elements.

* * * * *